US007356928B2

(12) United States Patent
Votolato

(10) Patent No.: US 7,356,928 B2
(45) Date of Patent: Apr. 15, 2008

(54) UTILITY KNIFE WITH SAFETY GUARD HAVING REDUCED PLAY

(75) Inventor: Earl J. Votolato, Newport Beach, CA (US)

(73) Assignee: Earl J. & Kimberly Votolato Trustees of the Votolato Living Trust, Newport Beach, CA (US)

( * ) Notice: Subject to any disclaimer, the term of this patent is extended or adjusted under 35 U.S.C. 154(b) by 396 days.

(21) Appl. No.: 10/936,891

(22) Filed: Sep. 8, 2004

(65) Prior Publication Data

US 2006/0048389 A1 Mar. 9, 2006

(51) Int. Cl.
*B26B 29/00* (2006.01)

(52) U.S. Cl. ..... 30/2; 30/286; 30/293; 30/294; 30/153; 30/320; 30/331

(58) Field of Classification Search ..... 30/2, 30/286, 293, 294, 125, 153, 151, 320, 331, 30/330, 340, 332, 162, 317
See application file for complete search history.

(56) References Cited

U.S. PATENT DOCUMENTS 4,757,612 A * 7/1988 Peyrot ..... 30/151
4,980,977 A 1/1991 Matin et al.
5,241,750 A * 9/1993 Chomiak ..... 30/2
5,878,501 A 3/1999 Owens et al.
6,070,326 A * 6/2000 Berns ..... 30/2
6,233,832 B1 * 5/2001 Berns ..... 30/162
6,453,559 B1 * 9/2002 Marshall et al. ..... 30/2
6,560,873 B1 * 5/2003 Ortner et al. ..... 30/2
2002/0124412 A1 * 9/2002 Votolato ..... 30/200

OTHER PUBLICATIONS

U.S. Appl. No. 09/804451, filed Sep. 2002, Votolato.
U.S. Appl. No. 10/300382, filed May 2004, Votolato.

* cited by examiner

*Primary Examiner*—Timothy V. Eley
(74) *Attorney, Agent, or Firm*—Fish & Associates, PC

(57) ABSTRACT

A utility knife has a protective guard that moves from a locked position to an unlocked position. Preferred mechanisms utilize a pawl that cooperates with a stop to reduce movement of the guard while the guard is in a locked position, and a simple latching mechanism that allows the pawl to bypass the stop. The pawl is disposed with respect to other elements of the mechanism such that the blade guard can only pulled back to a retracted position after operation of a trigger or other actuator, and then only for a single use. Both the stop and the catch can advantageously be carried in a fixed special relation to one another by operation of a trigger or other actuator.

20 Claims, 4 Drawing Sheets

FIG. 1
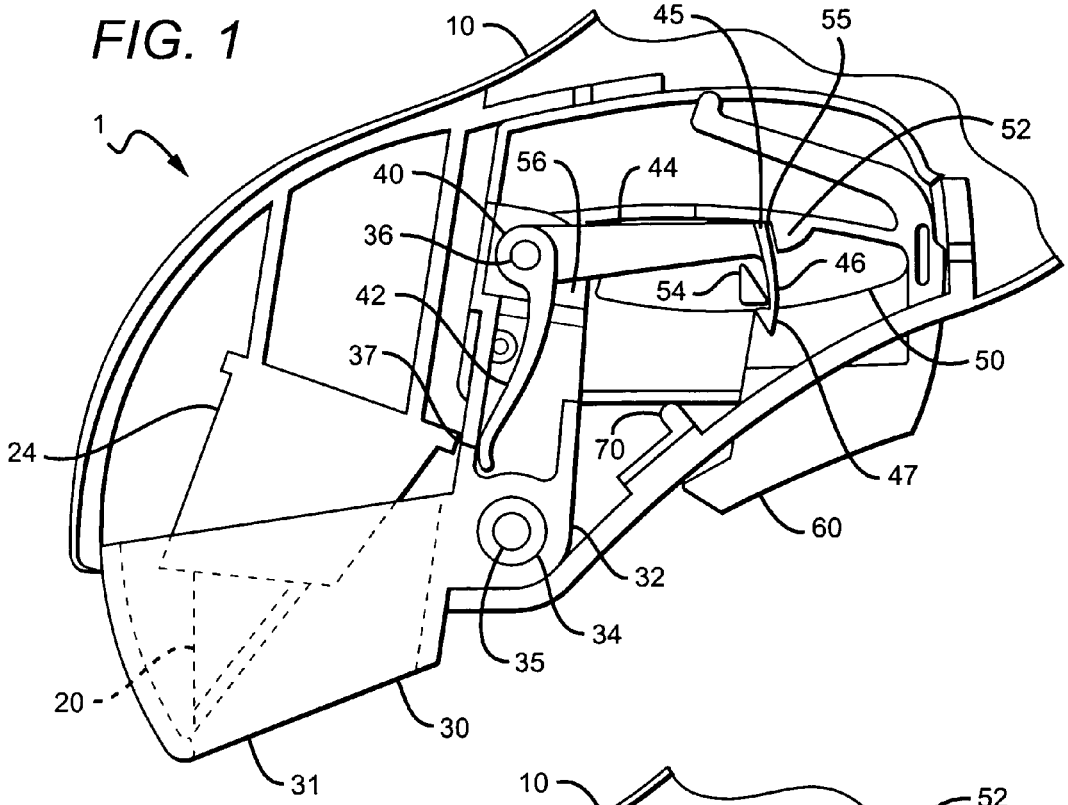
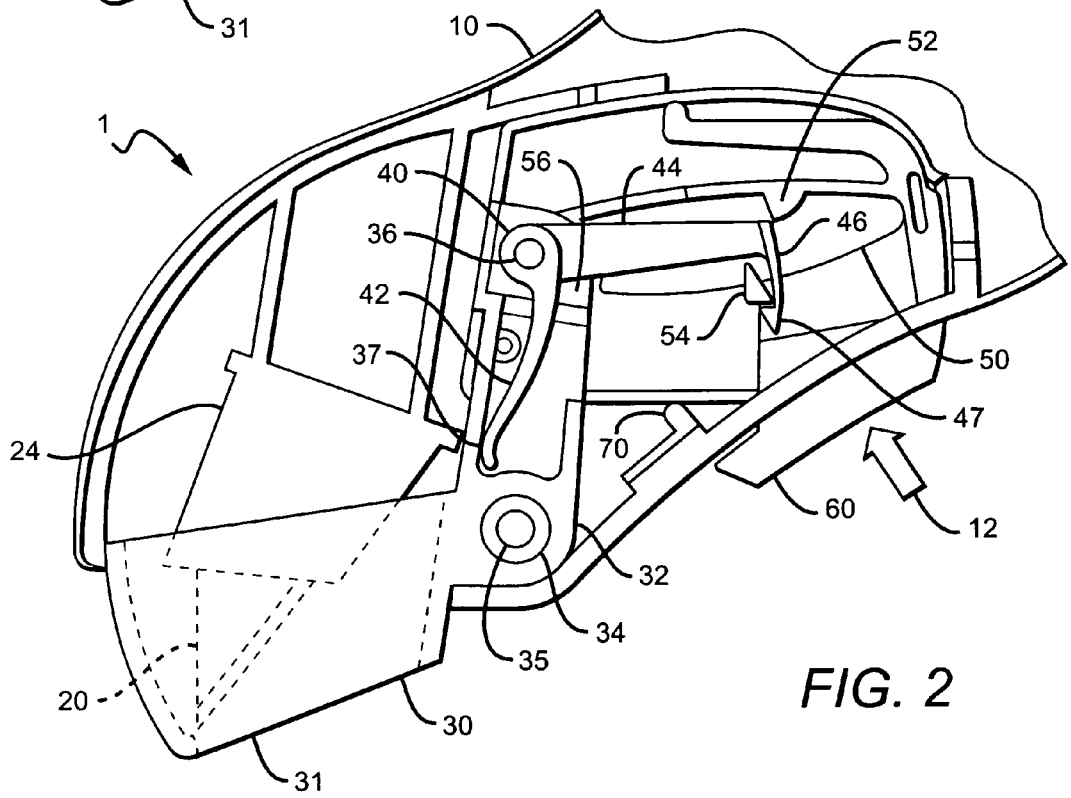
FIG. 2

FIG. 3
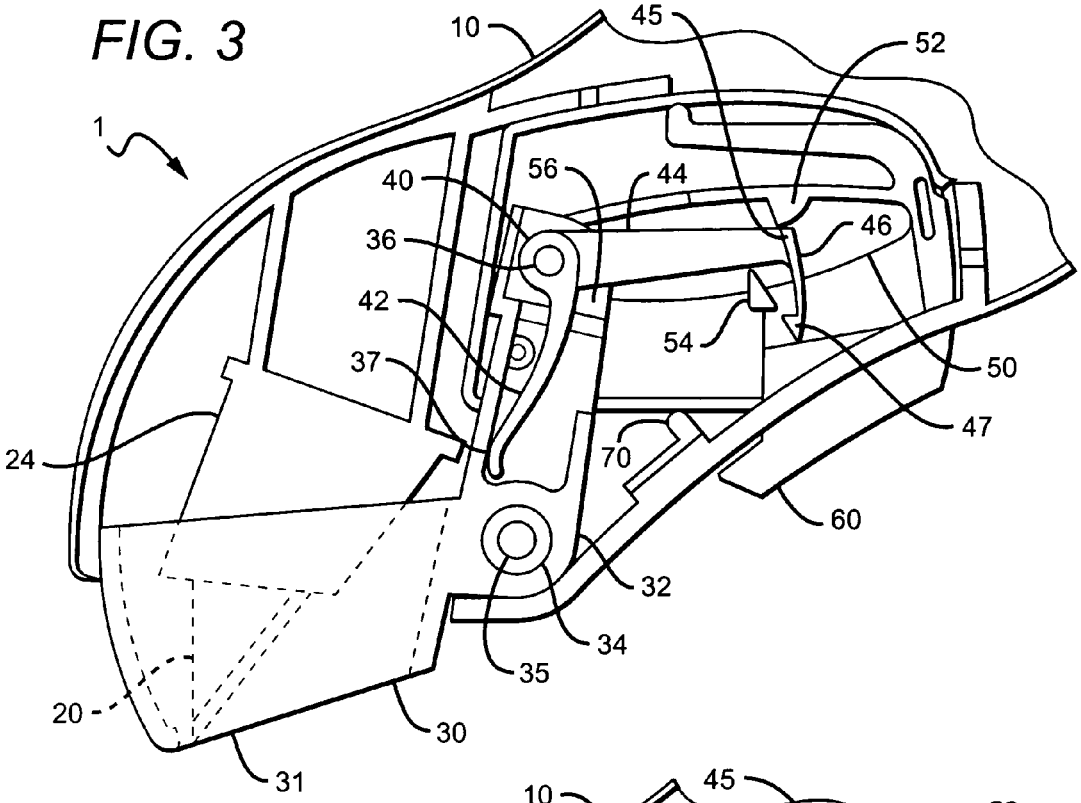
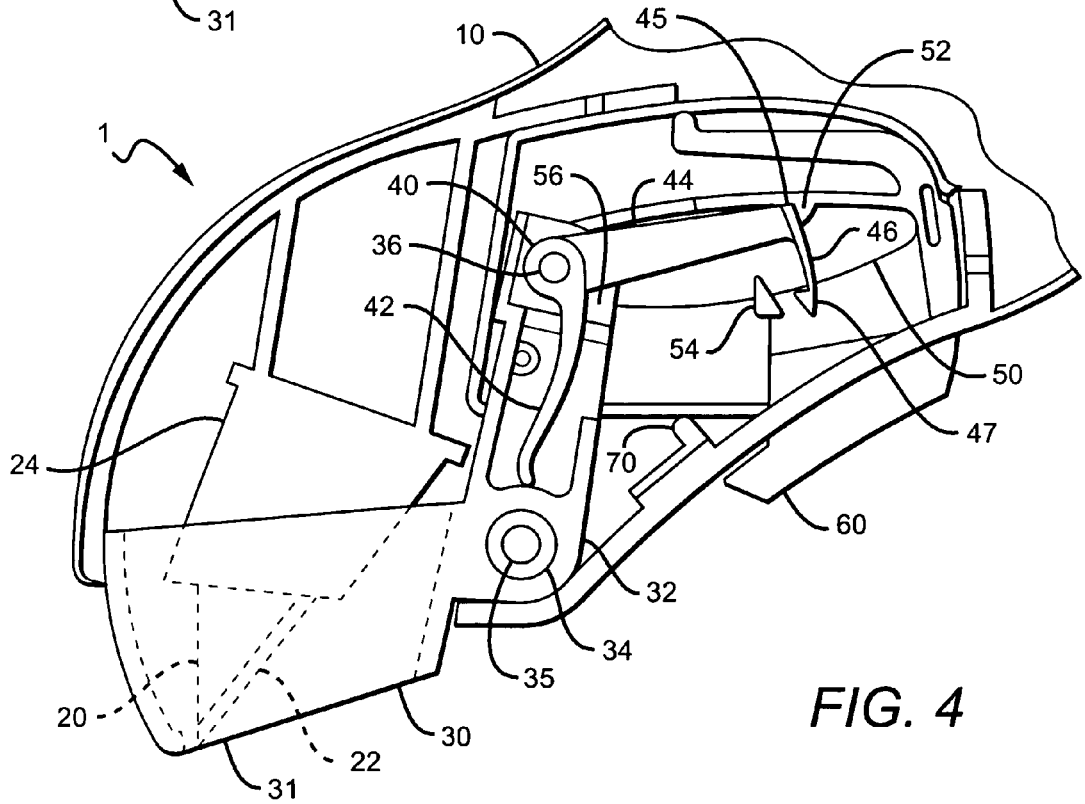
FIG. 4

FIG. 5
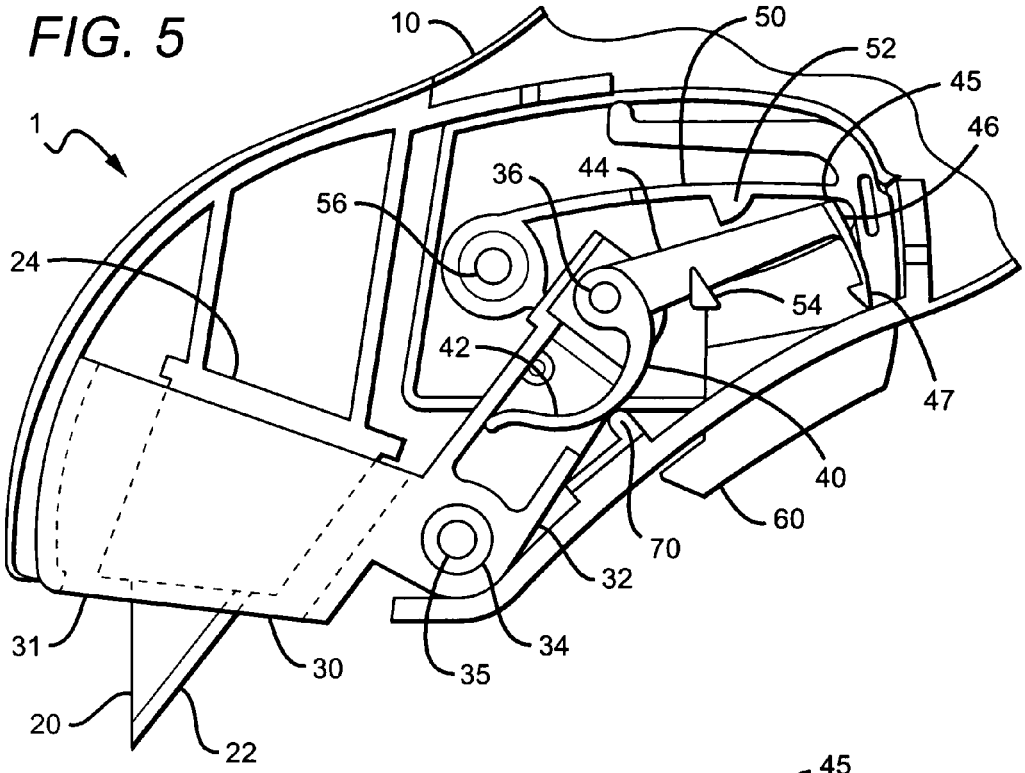
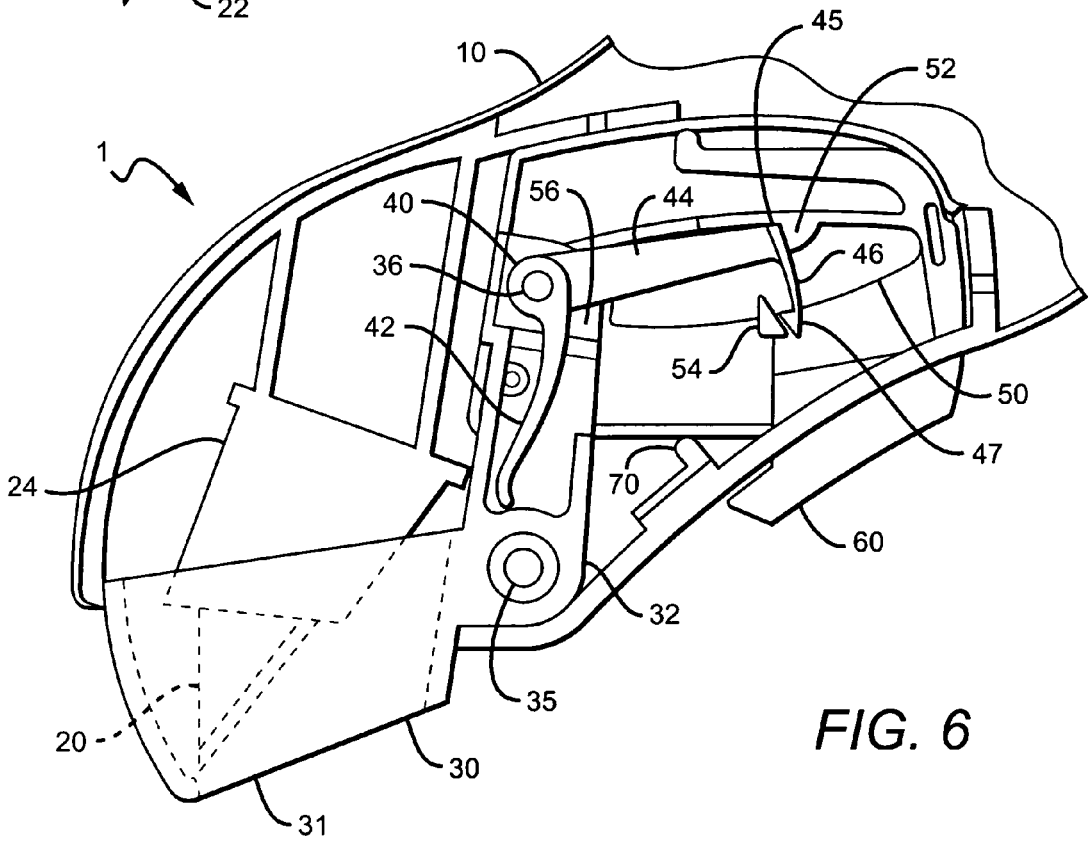
FIG. 6

FIG. 7
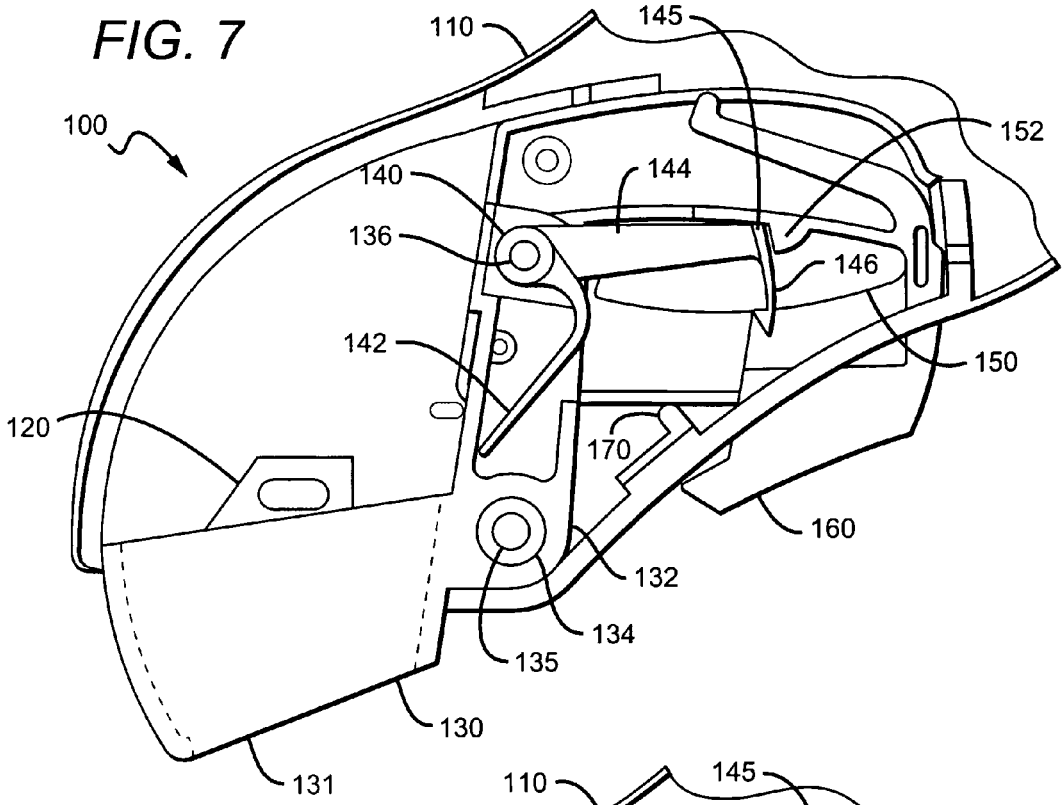
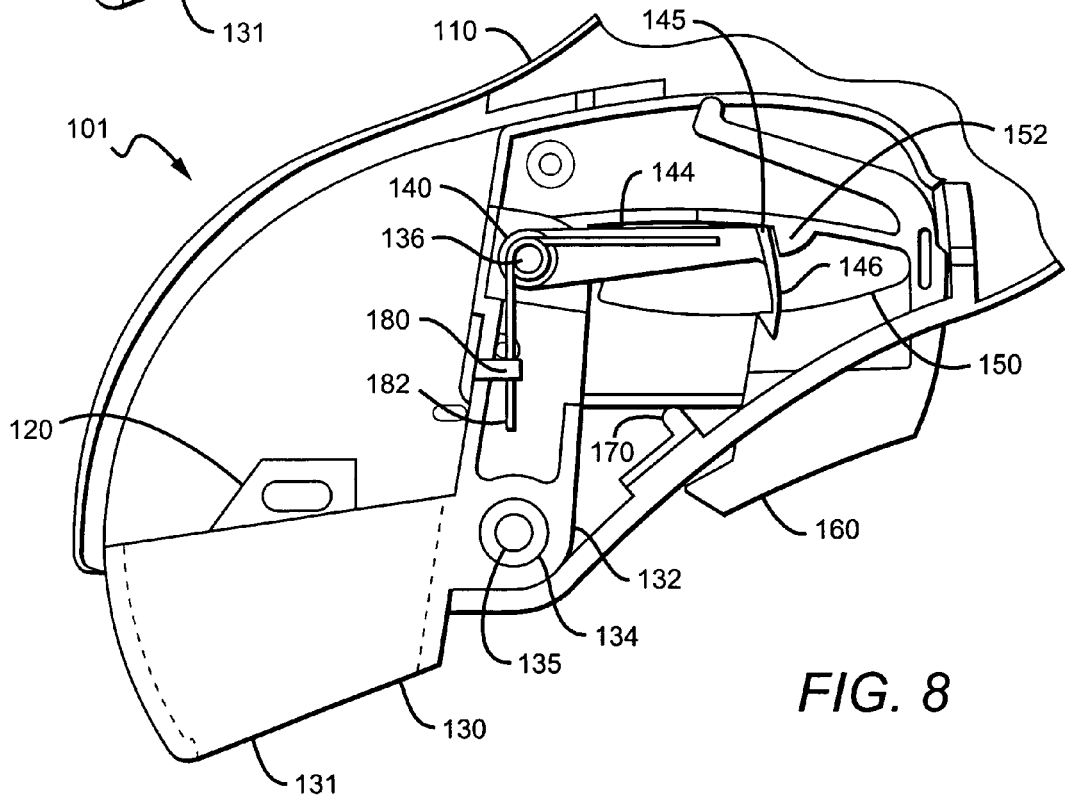
FIG. 8

UTILITY KNIFE WITH SAFETY GUARD HAVING REDUCED PLAY

FIELD OF THE INVENTION

The field of the invention is utility knives.

BACKGROUND OF THE SUBJECT MATTER

Utility knives typically have a sharp cutting blade that can either (a) be retracted into a housing, or (b) released to an operating disposition by movement of a protective blade guard. In either case problems arise where the blade is left in an unprotected disposition where it can accidentally cause injury to a user.

The problem of accidental injury has been long recognized, with numerous solutions being put forward at various times. U.S. Pat. No. 4,980,977 to Matin et al. (January 1991), for example, describes a knife having a safety guard that guards the blade when not in use, and automatically retracts as the blade is removed from the workpiece. The guard has a manually triggered self-locking release assembly that automatically relocks the guard when retracted. Unfortunately, Matin's locking mechanism is external to the housing housing, which is dangerous because the mechanism is readily subjected to debris that could jam or otherwise interfere with both the locking and unlocking functions. In addition, Matin's safety guard pivots off the blade externally to the housing housing, rather than being retracted into the housing. That operation is dangerous because the pivoted guard can readily interfere with operation of the knife.

U.S. Pat. No. 5,878,501 to Owens et al. (March 1999) uses an internal locking mechanism, but leaves the blade in the "use" position for multiple uses. There is no automatic re-locking mechanism, and withdrawal of the blade into the housing is entirely manual.

More recently the present inventor pioneered utility knives having a mechanism that automatically re-locks the protective blade guarding to prevent more than a single use of the blade. Pending applications include Ser. No. 09/804,451, published in September 2002 as 2003/0131393, and Ser. No. 10/300,382, published in May 2004 as 2004/0093734. These and all other referenced patents and applications are incorporated herein by reference in their entirety.

While providing considerable improvement over the prior art, the preferred embodiments of the utility knives described in the Ser. Nos. 09/804,451 and 10/300,382 applications have more "play" in the blade guard than might be desired in some circumstances. In the Ser. No. 10/300,382 application, for example, a preferred locking mechanism utilizes a pawl that rides in a looped pathway. Two ramped steps on the pathway limit the pawl's travel to a one-way direction, so that once the pawl starts along the pathway, it must finish a complete loop. The mechanism, however, allows some slight backward motion of the pawl, and thus introduces potentially undesirable play in the blade guard.

Thus, there is a need for an improved locking/releasing mechanism that automatically re-locks the protective blade guarding to prevent more than a single use of the blade, while reducing the play in the blade guard.

SUMMARY OF THE INVENTION

The present invention provides methods and apparatus in which a utility knife has a protective guard that moves from a locked position to an unlocked position. Preferred mechanisms utilize a pawl hat cooperates with a stop to reduce movement of the guard while the guard is in a locked position, and a simple latching mechanism that allows the pawl to bypass the stop. The pawl is disposed with respect to other elements of the mechanism such that the blade guard can only pulled back to a retracted position after operation of a trigger or other actuator, and then only for a single use. The guard cannot be retracted a second time until the actuator is released, and then operated anew.

In preferred embodiments pawl has a finger portion that juxtaposes the stop and operates against a pin. Both the stop and the catch can advantageously be carried in a fixed special relation to one another by operation of a trigger or other actuator.

"Play" of the protective guard is limited by the distance between the joint and the stop in the locked position, which distance is preferably less than 5 mm, more preferably less than 3 mm, still more preferably less than 2 mm, and most preferably less than 1 mm.

Various objects, features, aspects and advantages of the present invention will become more apparent from the following detailed description of preferred embodiments of the invention, along with the accompanying drawings in which like numerals represent like components.

BRIEF DESCRIPTION OF THE FIGURES

FIG. 1 is a side view of a portion of an opened utility knife case, with the blade guard in the deployed (protecting) position, and the pawl in a locked position.

FIG. 2 is a side view of the opened utility knife case of FIG. 1, showing the trigger in a depressed (actuated) position, and the pawl in an unlocked position.

FIG. 3 is a side view of the opened utility knife case of FIG. 1, showing the pawl in an unlocked position, and the blade guard moving away from the deployed position.

FIG. 4 is a side view of the opened utility knife case of FIG. 1, showing the pawl reverted to the locked position upon slight movement of the blade guard.

FIG. 5 is a side view of the opened utility knife case of FIG. 1, showing the blade guard in a retracted position, with the blade exposed.

FIG. 6 is a side view of the opened utility knife case of FIG. 1, showing the blade guard reverted back to a deployed position, and the pawl in a locked position.

FIGS. 7, 8 are side views of an alternative opened utility knife case, with components removed to show the pawl and pawl spring.

Various objects, features, aspects and advantages of the present invention will become more apparent from the following detailed description of preferred embodiments of the invention, along with the accompanying drawings in which like numerals represent like components.

DETAILED DESCRIPTION

In FIG. 1 a utility knife 1 generally comprises a housing 10 (only the front portion of which is shown), a blade 20, a blade guard 30, a pawl 40, a carriage that carries a stop 52 and a catch 54, and a trigger 60.

Housing 10 is preferably sized and dimensioned to fit comfortably in the hand of a user. Housing 10 can be made of any suitable material, including metals, alloys, and plastics, and can have a hollowed out section (not shown) for storing spare blades. Housing 10 is preferably ambidextrous, but alternatively can include contours that would tend to make the device more acceptable to right or left handed use.

The reader will note that housing 10 includes numerous structural elements that are not labeled.

Blade 20 is preferably triangular shaped at one or both ends, and has at least one cutting edge 22. Blade 20 is preferably made of non-rusting alloy, but can also be made of other materials, including for example various plastics. Blade 20 is shown here as being held by blade holder 24.

Blade guard 30 generally guards the blade 20 when the guard is in a fully deployed position (as show), and allows use of the blade when the guard is in the retracted position (see FIG. 5). To that end blade guard 30 has a slit along one edge 31 through which at least a portion of the edge 22 of blade 20 can extend. Guard 30 is continuous with guard arm 32, and pivots about pivot 34. The pin 35 for pivot 34 is preferably fixed to or extending from the housing 10. Guard arm 32 also carries a pin or pin portion 36 about which the pawl 40 pivots. Blade guard 30 is preferably made of transparent or at least translucent plastic, so that the user can see the blade being protected. Alternatively, blade guard 30 can be made of metal or any other suitable material or materials.

Pawl 40 has a first pawl arm 42 that pushes against the guard arm 32 at area 37, and thereby biases the blade guard 30 into the deployed position shown in the Figure. To that end first pawl arm 42 is should have some degree of springiness, whether inherently or through addition of an additional spring (not shown). Pawl 40 also has a second pawl arm 44 that cooperates with stop 52 to prevent guard arm 32 from pivoting about pin 35, and thereby prevents the blade guard 30 from retracting. Second pawl arm 44 has a joint 45 (which could also be called an elbow), and extending from the joint 45 is a finger 46 (which is also referred to herein as a latch) that cooperates with catch 54 in a latching motion. It is the finger 46 and in part the joint 45 that actually juxtapose the stop 52. Pawl 40 is preferably constructed of a single, continuous piece of metal alloy, or plastic.

Carriage 50 pivots about pin 56, which is attached to or extending from housing 10. The pivoting motion is controlled by depression and release of trigger 60. Stop 52 and catch 54 are each preferably attached to or extending from the carriage 50, with their respective positions fixed at a distance of less than 2 cm., depending on the width of second pawl arm 44. Carriage 50, stop 52, and catch 54 can be made from any suitable material or materials, and can be shaped as shown or can have any other suitable shapes.

Trigger 60 is shown on the underside of the housing 10, and is positioned relatively forward so that the trigger is easily operated by the users forefinger. All other suitable positions are contemplated, including positions on the top or side of the housing 10. Those skilled in the art will also appreciate that the trigger 60 is merely emblematic of a more general actuator, which could take the form of a push button, a slider, and so forth. Trigger 60 is preferably constructed from metal or plastic.

In FIG. 1 the utility knife 1 is shown with the blade guard 30 in the deployed (protecting) position, and the pawl 40 in a locked position. Locking is accomplished by the approximate juxtaposition of joint 45 and finger 36 against stop 52. In this position the maximum distance between finger 36 and stop 52 determines the play (slight movement) that blade guard 30 can undergo. As such it is beneficial if the distance 55 is less than 5 mm, more preferably less than 3 mm, even more preferably less than 2 mm, and most preferably less than 1 mm.

In FIG. 2 the trigger 60 has been depressed (squeezed) against the housing 10 in the direction of arrow 12, with the effect that the carriage 50 has rotated upwards (from the point of view of the drawing). That motion has disengaged the finger 46 from the stop 52, which will subsequently allow the second pawl arm 44 to move to the right past the stop 52. The pawl is thus in an unlocked position in this Figure.

In FIG. 3 the blade guard 30 has been pushed back slightly, enough to displace the joint 47 and finger 46 past the stop 45, but not enough for the blade 22 to protrude through the slit 31 in the blade guard 30. If, from this position the pressure against the blade guard 30 is removed, so that the blade guard 30 reverts back to the fully deployed position of FIG. 1, then the pawl arm 44 at joint 45 and finger 46 would re-lock against the stop 52. That situation is shown in FIG. 4.

In FIG. 5 the blade guard 30 has been pushed back to its greatest extent, as limited by the guard arm 32 striking rest 70 attached to or formed as part of the housing 10. In this position the blade 20 extends through slot 31 to a maximal extent, which in preferred embodiments exposes the cutting edge 22 of the blade 20 to depth of at least 8 mm, more preferably at least 9 mm, still more preferably at least 10 mm, and most preferably almost 11 mm. Movement of the blade guard 30 is presumably caused by the user pushing the guard 30 against a cardboard box or other surface being cut (not shown), with the blade guard 30 being retracted and the blade 20 being forced into the box material.

In FIG. 6 the pressure on the blade guard 30 has been removed, and the guard 30 has returned to its fully deployed position. This presumably occurs because the user has made the needed cut, and removed the blade 20 from the surface being cut. Since the blade guard 30 is continuous with guard arm 32, pivoting about pin 35, the portion of guard arm 32 containing pin 36 is also returned to its native position, which carries joint 45 and finger 46 back to engage stop 52.

In this position the blade guard 30 cannot be retracted because there is nothing to disengage the joint 45 and finger 46 from the stop 52. To disengage and restart the cycle, the trigger 60 must be released, which would carry the hooked end 47 of finger 46 to where it would latch against catch 54. This brings us full cycle back to FIG. 1. Of course, the trigger 60 need not be operated during the entire cutting cycle, and can be release as soon as the latching mechanism is unlocked.

In an alternative embodiment of FIGS. 7 and 8, a utility knife 100 generally comprises a housing 100 (only the front portion of which is shown), a blade 120, a blade guard 130, a pawl 140, a carriage that carries a stop 152 and a catch 154, and a trigger 160. Except as noted below, all of the components are substantially similar to those in FIGS. 1-6, with component numbering of FIG. 7 being higher by 100 relative to those of FIGS. 1-6.

Pawl 140 has a first pawl arm 142 that pushes against the guard arm 132 at area 137, and thereby biases the blade guard 130 into the deployed position shown in FIG. 7. To that end first pawl arm 142 is should have some degree of springiness, whether inherently or through addition of an additional spring (not shown). Pawl 140 also has a second pawl arm 144 that cooperates with stop 152 to prevent guard arm 132 from pivoting about pin 135, and thereby prevents the blade guard 130 from retracting. Second pawl arm 144 has a joint 145 (which could also be called an elbow), and extending from the joint 145 is a finger 146 (which could be utilized as a latch, but which is not necessarily utilized in this embodiment). It is the finger 146 and in part the joint 145 that actually juxtapose the stop 152. Pawl 140 is preferably constructed of a single, continuous piece of metal alloy, or plastic. In FIG. 7, the latch and catch are embodied not by the finger 146, but by a catch 180 operating on spring 182. As will be appreciated, spring 182 exerts a force on the pawl 140 during at least some portion of the operation of the blade guard 130.

It should therefore be appreciated that the two embodiments shown in the Figures are merely exemplary, and only depict one of many possible embodiments corresponding to the disclosed subject matter. What is contemplated herein is the entire class of embodiments of utility knives where a blade guard automatically re-locks after each use, and in which a pawl is used in conjunction with a stop and a catch to limit the play in the blade guard.

Thus, several specific embodiments and applications of utility knives have been described. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. An improved utility knife having a body, a blade, and a blade guard coupled to the body, the blade guard disposed to intermittently protect a cutting edge of the blade, the improvement comprising:

the blade guard being shorter than, and pivotally coupled to the body;

a pawl coupled to the blade guard; and the pawl having a first portion that operates against a stop to prevent the blade guard from exposing the cutting edge, and a second portion that operates against a catch to bypass the stop.

2. The utility knife of claim 1 wherein the pawl hinges on the blade guard.

3. The utility knife of claim 1 wherein the first portion is located at a joint of the pawl.

4. The utility knife of claim 1 wherein the second portion comprises a finger located at an end of the pawl.

5. The utility knife of claim 1 wherein an arm of the pawl biases the blade guard into a deployed position.

6. The utility knife of claim 1 wherein a first arm of the pawl biases the blade guard into a deployed position, and a second arm of the pawl cooperates with the stop and the catch to lock and unlock the blade guard.

7. The utility knife of claim 1 wherein the stop is disposed in a fixed special relation to a pin.

8. The utility knife of claim 1 wherein the stop and the catch are carried on a member that can be pivoted by operation of an actuator.

9. The utility knife of claim 1 wherein the catch acts upon a spring that exerts a force on the pawl.

10. The utility knife of claim 1 wherein the actuator comprises a trigger mounted on an underside of the body.

11. The utility knife of claim 10 wherein the first portion is maintained within 5 mm of the stop prior to release of an actuator.

12. The utility knife of claim 1 wherein the first portion is maintained within 5 mm of the stop prior to release of an actuator.

13. The utility knife of claim 1 wherein the first portion is maintained within 3 mm of the stop prior to release of an actuator.

14. The utility knife of claim 1 wherein the first portion is maintained within 2 mm of the stop prior to release of an actuator.

15. The utility knife of claim 1 wherein the first portion is maintained within 1 mm of the stop prior to release of an actuator.

16. The utility knife of claim 1 wherein the pawl hinges on the blade guard, the first portion is located at a joint of the pawl, and the second portion comprises a finger located at an end of the pawl.

17. The utility knife of claim 1 wherein the stop is disposed in a fixed special relation to a pin, and the stop and the catch are carried on a member that can be pivoted by operation of an actuator.

18. The utility knife of claim 1 wherein the pawl is disposed with respect to the stop and the catch such that the pawl locks the blade guard in a protective position, releases the blade guard to an operating position upon operation of an actuator, and automatically re-locks the blade guard to prevent more than a single use of the blade until further operation of the actuator.

19. The utility knife of claim 18 wherein movement of the blade guard allows the cutting edge of the blade to be exposed to a depth of at least 8 mm.

20. The utility knife of claim 18 wherein movement of the blade guard allows the cutting edge of the blade to be exposed to a depth of at least 10 mm.

* * * * *

UNITED STATES PATENT AND TRADEMARK OFFICE
Certificate

Patent No. 7,356,928 B2 Patented: April 15, 2008

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: David A. Sharbaugh, Irvine, CA (US); and Earl J. Votolato, Newport Beach, CA (US).

Signed and Sealed this Twenty-second Day of February 2011.

BOYER D. ASHLEY
*Supervisory Patent Examiner*
Art Unit 3724
Technology Center 3700

US007356928C1

(12) INTER PARTES REEXAMINATION CERTIFICATE (0328th)

United States Patent

Votolato

(10) Number: US 7,356,928 C1

(45) Certificate Issued: Dec. 6, 2011

(54) UTILITY KNIFE WITH SAFETY GUARD HAVING REDUCED PLAY

(75) Inventor: Earl J. Votolato, Newport Beach, CA (US)

(73) Assignee: Spellbound Development Group, Inc., Irvine, CA (US)

Reexamination Request:
No. 95/001,442, Sep. 27, 2010

Reexamination Certificate for:

| | |
|---|---|
| Patent No.: | **7,356,928** |
| Issued: | **Apr. 15, 2008** |
| Appl. No.: | **10/936,891** |
| Filed: | **Sep. 8, 2004** |

Certificate of Correction issued Feb. 22, 2011.

(51) Int. Cl.
*B26B 29/00* (2006.01)

(52) U.S. Cl. ..... 30/2; 30/286; 30/293; 30/294; 30/153; 30/320; 30/331

(58) Field of Classification Search ..... None
See application file for complete search history.

(56) References Cited

To view the complete listing of prior art documents cited during the proceeding for Reexamination Control Number 95/001,442, please refer to the USPTO's public Patent Application Information Retrieval (PAIR) system under the Display References tab.

*Primary Examiner*—Glenn K. Dawson

(57) ABSTRACT

A utility knife has a protective guard that moves from a locked position to an unlocked position. Preferred mechanisms utilize a pawl that cooperates with a stop to reduce movement of the guard while the guard is in a locked position, and a simple latching mechanism that allows the pawl to bypass the stop. The pawl is disposed with respect to other elements of the mechanism such that the blade guard can only pulled back to a retracted position after operation of a trigger or other actuator, and then only for a single use. Both the stop and the catch can advantageously be carried in a fixed special relation to one another by operation of a trigger or other actuator.

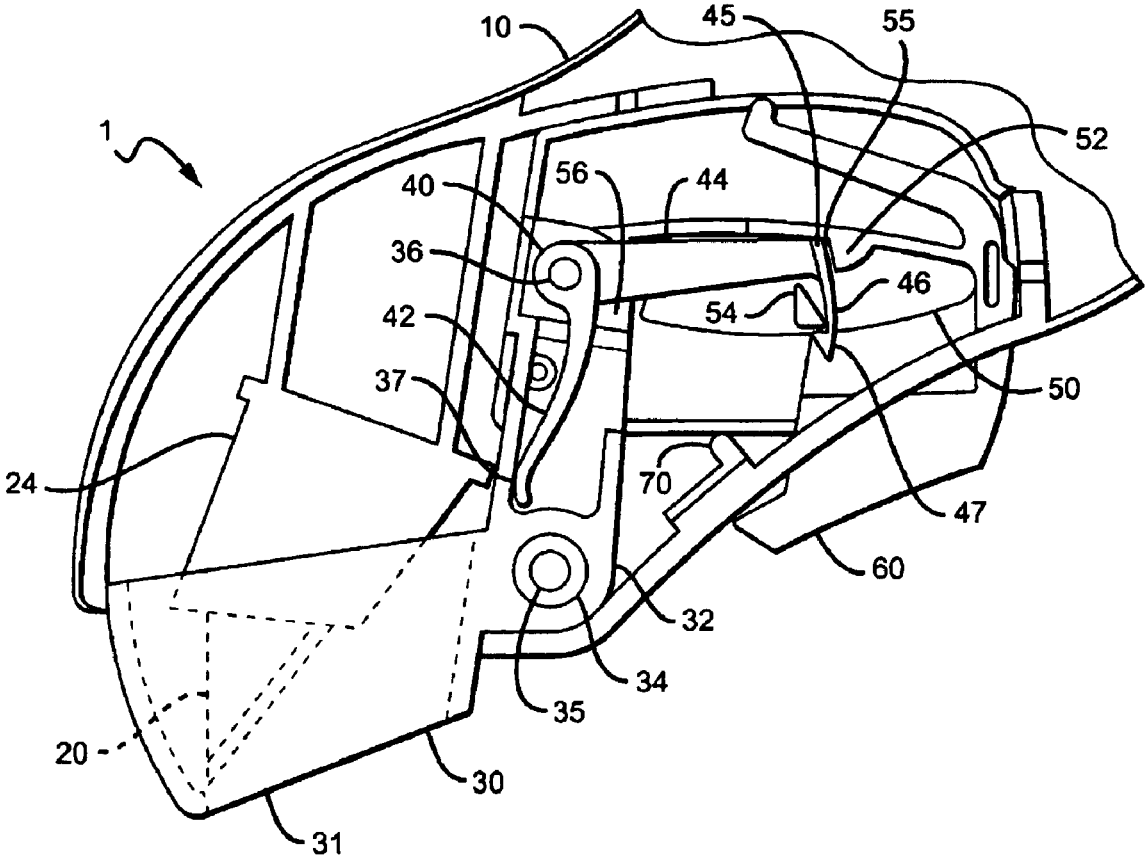

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3-5, 7-9 and 12-20 are cancelled.

Claims 2 and 10 are determined to be patentable as amended.

Claim 11, dependent on an amended claim, is determined to be patentable.

Claim 6 was not reexamined.

2. [The utility knife of claim 1] *An improved utility knife having a body, a blade, and a blade guard coupled to the body, the blade guard disposed to intermittently protect a cutting edge of the blade, the improvement comprising:*

*the blade guard being shorter than, and pivotally coupled to the body;*

*a pawl coupled to the blade guard; and*

*the pawl having a first portion that operates against a stop to prevent the blade guard from exposing the cutting edge, and a second portion that operates against a catch to bypass the stop;*

*wherein the catch acts upon a spring that exerts a force on the pawl;* wherein the pawl hinges on the blade guard.

10. [The utility knife of claim 1]

*An improved utility knife having a body, a blade, and a blade guard coupled to the body, the blade guard disposed to intermittently protect a cutting edge of the blade, the improvement comprising:*

*the blade guard being shorter than, and pivotally coupled to the body;*

*a pawl coupled to the blade guard; and*

*the pawl having a first portion that operates against a stop to prevent the blade guard from exposing the cutting edge, and a second portion that operates against a catch to bypass the stop;*

*wherein the catch acts upon a spring that exerts a force on the pawl;* wherein the actuator comprises a trigger mounted on an underside of the body.

* * * * *